US010308012B2

(12) United States Patent
Bumm et al.

(10) Patent No.: US 10,308,012 B2
(45) Date of Patent: Jun. 4, 2019

(54) METHOD FOR CHECKING THE MAINTENANCE OF REGISTER OF PRINTED IMAGES TO BE PRINTED ON TWO OPPOSITE SIDES OF A PRINTING MATERIAL

(71) Applicant: KOENIG & BAUER AG, Würzburg (DE)

(72) Inventors: Florian Bumm, Kitzingen-Sickershausen (DE); Steffen Fischer, Dipbach (DE); Sebastian Franz, Leinach (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 16/083,582

(22) PCT Filed: Mar. 7, 2017

(86) PCT No.: PCT/EP2017/055317
§ 371 (c)(1),
(2) Date: Sep. 10, 2018

(87) PCT Pub. No.: WO2017/153404
PCT Pub. Date: Sep. 14, 2017

(65) Prior Publication Data

US 2019/0084293 A1 Mar. 21, 2019

(30) Foreign Application Priority Data

Mar. 11, 2016 (DE) ..... 10 2016 204 072

(51) Int. Cl.
*B41F 33/00* (2006.01)
*B41F 13/14* (2006.01)
(Continued)

(52) U.S. Cl.
CPC ..... *B41F 33/0036* (2013.01); *B41F 11/02* (2013.01); *B41F 13/025* (2013.01);
(Continued)

(58) Field of Classification Search
None
See application file for complete search history.

(56) References Cited

U.S. PATENT DOCUMENTS 2,194,467 A * 3/1940 Corbin ..... B41F 13/02 101/228
5,036,863 A 8/1991 Wheeler
(Continued)

FOREIGN PATENT DOCUMENTS

DE 29807663 U1 8/1998
DE 29819735 U1 1/1999
(Continued)

OTHER PUBLICATIONS

International Search Report of PCT/EP2017/055317 dated Jun. 13, 2017.

*Primary Examiner* — Jill E Culler
(74) *Attorney, Agent, or Firm* — Mattingly & Malur, PC

(57) ABSTRACT

A method for checking the maintenance of register of printing images to be printed on two opposite sides of a printing material, in which the first side of the printing material is printed in a rotary printing press by a first printing unit cylinder, and in which the second side of the printing material, which lies opposite to first cite, is printed in the printing press by a second printing unit cylinder which interacts with the first printing unit cylinder. A printed image is printed by the first printing unit cylinder under the second printing unit cylinder. Afterwards, the printing material is printed in contact with the two interacting printing unit cylinders with the printing image, which is printed under the second printing unit cylinder, being printed onto the same
(Continued)

side of the printing material together with an identical or a different printing image which is to be printed by the second printing unit cylinder during continuous printing of the rotary printing press. The printed images, which are printed together onto the same side of the printing material, are subsequently checked, with regard to their maintenance of register.

10 Claims, 2 Drawing Sheets

(51) Int. Cl.

| | |
|---|---|
| ***B41F 13/16*** | (2006.01) |
| ***B41F 13/02*** | (2006.01) |
| ***B41F 27/00*** | (2006.01) |
| ***B41F 35/06*** | (2006.01) |
| ***B41F 11/02*** | (2006.01) |

(52) U.S. Cl.

CPC ..... *B41F 13/14* (2013.01); *B41F 13/16* (2013.01); *B41F 27/005* (2013.01); *B41F 33/0009* (2013.01); *B41F 35/06* (2013.01); *B41P 2213/91* (2013.01)

(56) References Cited

U.S. PATENT DOCUMENTS

| | | | | |
|---|---|---|---|---|
| 5,535,675 | A * | 7/1996 | Gentle | B41F 13/14 101/248 |
| 9,387,665 | B2 | 7/2016 | Schwitzky | |
| 2012/0090485 | A1 | 4/2012 | Nitta et al. | |
| 2015/0246526 | A1 | 9/2015 | Schwitzky | |

FOREIGN PATENT DOCUMENTS

| | | | |
|---|---|---|---|
| DE | 19945979 | | 2/2001 |
| DE | 10260124 | A1 | 7/2004 |
| DE | 10322547 | A1 | 12/2004 |
| DE | 102007053594 | A1 | 5/2009 |
| DE | 102009012436 | A1 | 9/2010 |
| DE | 102012214585 | A1 | 2/2014 |
| EP | 2269824 | A1 | 1/2011 |
| EP | 2447071 | A1 | 5/2012 |
| JP | 60-085961 | A | 5/1985 |
| JP | 05-254105 | A | 10/1993 |

* cited by examiner

METHOD FOR CHECKING THE MAINTENANCE OF REGISTER OF PRINTED IMAGES TO BE PRINTED ON TWO OPPOSITE SIDES OF A PRINTING MATERIAL

CROSS REFERENCE TO RELATED APPLICATIONS

This application is the U.S. National Phase, under 35 U.S.C., section 371, of PCT/EP2017/055317, filed Mar. 7, 2017; published as WO 2017/153404A1, on Sep. 14, 2017, and claiming priority to DE 102016204072.3, filed Mar. 11, 2016, the disclosures of which are expressly incorporated herein in their entireties by reference.

FIELD OF THE INVENTION

The present invention relates to a method for checking the register accuracy of print images to be printed onto two opposite sides of a printing substrate. The first side of the printing substrate is printed in a rotary printing machine by a first printing unit cylinder. The second side of the printing substrate, opposite to the first side, is printed in the printing process by a second printing unit cylinder cooperating with the first printing unit cylinder.

BACKGROUND OF THE INVENTION

To ensure the quality of printed products produced with a rotary printing machine, it is necessary to check the register accuracy of printed images printed in the rotary printing machine on both sides, i.e. on two opposite sides, of a printing substrate. This check, which is necessary particularly in the production of more expensive printed products, e.g. products to be produced in security printing or high-quality package printing processes, is carried out at least during the makeready phase of the rotary printing machine, i.e. before the rotary printing machine goes into production, i.e. before it begins production printing, wherein during the makeready phase, modules of the rotary printing machine that will be involved in the production process are adjusted in terms of their interaction in such a way that waste paper resulting from poor register accuracy is avoided as much as possible. The term register is understood here as a matching of printed images printed onto the front and back sides of the printing substrate. This means that print images printed onto the two opposite sides of the printing substrate must be in a prescribed relationship in terms of their position relative to one another, preferably factoring in specified tolerances, and this relationship must remain as unchanged as possible during production printing on the rotary printing machine, since any deviation from a setpoint value specified for this relationship, in particular a deviation that exceeds the specified tolerances, will have a negative impact on quality. The relationship involving the relative position of print images printed onto both sides of the printing substrate consists, e.g. in these print images being arranged as congruently as possible, or complementing one another to form a single geometric figure, or e.g. separated from one another in their respective positions at a fixed distance from one another, e.g. defined by the setpoint value. The print images may be embodied, e.g. as any geometric figures or image elements or decorations, or as characters or as symbols or as page numbers or as a full type area. The print image may be a security feature, e.g. of a banknote or of some other security document. This security feature is configured, e.g. such that on the front and back sides, at one point on the banknote or the security document, e.g. partial decorations are located which, when viewed against a light source, i.e. viewing through the document, combine to form a complete decoration. Such security features are preferably produced in what is known as a simultaneous printing process. The printing substrate is preferably embodied as at least one printing sheet and consists, e.g. of paper, cardboard or paperboard.

From DE 102 60 124 A1, a transparent security element for security documents is known, comprising superimposed patterns on two opposite sides of a translucent substrate material, the two patterns complementing one another when arranged true to register to form a complete image.

From DE 10 2007 053 594 A1, a device for determining perfecting register in the case of a printing sheet printed on both sides is known, in which a first register element on the recto side and a second register element on the verso side of the printing sheet can be illuminated, and the relative positions of the illuminated register elements can be compared, said device comprising a beam deflecting device which has an intake for insertion of a printed sheet bearing the register elements and which mirrors the images reflected by the illuminated register elements one above the other or side by side, allowing the position of the register elements to be assessed from a display monitor.

From DE 199 45 979 C1, a device for measuring measurement marks on the upper side and the underside of a printed product relative to one another and relative to a printed product edge is known, said device consisting of two measurement transducers, each associated with one side of the printing substrate, at least one reference mark carrier, and a clamping device, wherein the clamping device consists of two clamping elements, the clamping elements being mounted rotatably relative to one another about a common bearing axis of a bearing and each of the clamping elements extending in the bearing axis having a longitudinal slit which together form a clamping gap when closed, wherein the printed product can be inserted into this clamping gap and secured by rotation of the clamping elements, and the measurement marks including the printed product edge lie in the region of the slit opening.

From DE 298 07 663 U1, a device for determining the perfecting register of sheets printed on the rector and verso sides is known, wherein a measuring device assigned to the recto side of the sheet and a measuring device assigned to the verso side of the sheet are provided for detecting the position of points on the recto and verso sides of the sheet, and the sheet can be fed in between the two measuring devices and fixed in a position designated for the measurement.

From DE 298 19 735 U1, a device for determining the perfecting register of a sheet printed on both sides is known, in which a first register element on the recto side of the sheet and a second register element on the verso side of the sheet can be illuminated, and the positions of the illuminated register elements relative to one another can be compared, wherein a beam deflecting device that includes a sheet intake for insertion of a sheet section bearing the register elements mirrors the images reflected by the illuminated register elements one above the other or side by side in such a way that the position of the register element on the recto side and the position of the register element on the verso side can be assessed relative to one another on a display monitor.

From JP H05 254 105 A, a register mark inspection device is known, which inspects the positional relationship between register marks on the front side and the reverse side of a printed product, wherein the register mark inspection device has two lenses, each of which generates an image of one of the register marks on the front side and the reverse side of the printed product, and which are arranged opposite one another.

From DE 103 22 547 A1, a method is known for determining and correcting register deviations on sheets that are printed on both sides in sheet-fed printing machines that include a measuring device for sheet inspection, which has a measuring table and a measuring head that is movable parallel to the measuring table, wherein the measuring table is equipped with vertical and horizontal sheet stops outside of the maximum sheet format, and the positioning system of the movable measuring head is capable of detecting the position of measuring points on the sheets to within 1/100 mm, said method comprising the following steps:

- printing register marks onto the front and reverse sides of a sheet during perfecting printing in a sheet-fed printing machine,
- placing the sheet on the measuring table and aligning the sheet against horizontal and vertical sheet stops associated with the same corner of the sheet,
- determining the horizontal and vertical distance of the register mark associated with said corner of the sheet on the front side of the sheet from the nearest lateral edges of the sheet using a positioning system in the measuring head,
- turning the printing substrate sheet and aligning the same corner of the sheet against the opposite stops in the direction of turning,
- determining the horizontal and vertical distance of the register mark associated with the same corner of the sheet on the back side of the sheet from the nearest lateral edges of the sheet using the positioning system in the measuring head,
- calculating the differences in position between the register marks on the front and reverse sides of the sheet,
- correcting the position of the printing cylinders using the determined position differences as a basis, to produce congruence of the register marks.

From EP 2 447 071 A1 a lateral register correcting device is known, having a register correcting unit, which is capable of correcting register movement of a fiber web through each of a plurality of printing units, and a fan out correcting unit, which is capable of correcting a width of the fiber web stretched in a widthwise direction, the lateral register correcting device comprising: a) a register detection and estimation unit capable of estimating and detecting a register correction amount by the register correcting unit based on at least two register marks, which are printed onto the fiber web by each of the printing units when a plurality of printing units are printing on an advancing fiber web for carrying out a correction by means of the register correcting unit and the fan out correcting unit; b) a register correction control unit capable of automatically controlling the register correcting unit in real time based on the register correction amount derived by the register detection and estimation unit; c) a fan out detection and estimation unit capable of estimating and detecting a fan out correction amount by the fan out correcting unit based on a register mark; and d) a fan out correction control unit capable of automatically controlling the fan out correcting unit in real time based on the fan out correction amount derived by the fan out detection and estimation unit, wherein the register marks are printed onto a front side and a reverse side of the fiber web.

From U.S. Pat. No. 5,036,763, a convertible multi-color printing machine for recto and verso printing, in particular of banknotes, is known, said machine being composed of two substantially identically constructed halves, each having a first cylinder, an image transfer cylinder pressed against this first cylinder, a second cylinder embodied as a blanket cylinder, which is displaceable between an offset printing position, in which it is pressed against the first cylinder, and a collect printing position, in which it is moved away from the first cylinder, a plurality of convertible cylinders in contact with said blanket cylinder, which are formed as offset plate cylinders in the offset printing position and as ink selection cylinders in the collect printing position and can each be inked up by an inking unit, a displaceable collect printing plate cylinder, assigned to the blanket cylinder, which in the offset printing position can be moved away from the blanket cylinder to a non-operating position and which in the collect operating position cooperates both with the blanket cylinder and with the image transfer cylinder, and in at least one of the machine halves, an additional printing unit having a plate cylinder inked up by a dedicated inking unit, wherein the first two cylinders of each machine half function as adjacent printing cylinders lying side by side, wherein a first printing nip is formed between the printing cylinder and the image transfer cylinder of each machine half, and in the offset printing position, a second printing nip is formed between the printing and blanket cylinders pressed against one another, wherein the paper to be printed first wraps partially around one printing cylinder in one direction, and after passing through the nip between the two printing cylinders wraps partially around the other printing cylinder in the other direction, wherein the paper passes through the printing nips in both machine halves during printing first of the one side of the paper and then the other side of the paper, and wherein the plate cylinder of the additional printing unit inks up the image transfer cylinder.

SUMMARY OF THE INVENTION

The object of the present invention is to provide a method for checking the register accuracy of print images to be printed onto two opposite sides of a printing substrate.

The object is attained according to the present invention by the printing of a print image, which is printed by the first printing unit cylinder, under the second printing unit cylinder.

The printing substrate is then printed in contact with the two cooperating printing unit cylinders. The print image, which is printed onto the second printing unit cylinder, is printed, together with the same or a different print image, to be printed by the second printing unit cylinder in the production printing phases of rotary printing machine, onto the same side of the printing substrate. These print images, which are printed together on the same side of the printing substrate, are then checked with regard to their register accuracy.

The advantages to be achieved by the invention consist in particular in that the register accuracy of print images printed onto two opposite sides of a printing substrate can be checked without the aid of a reference outside of the printed image. In particular, print images designated for opposite sides of the printing substrate can also be checked immediately and directly by viewing the same side of the printing substrate or by capturing these printed images simultaneously in the same photographic image. The proposed method is therefore also suitable for printing substrates of low transparency.

BRIEF DESCRIPTION OF THE DRAWINGS

One exemplary embodiment of the invention is illustrated in the set of drawings and will be described in more detail in the following, in which further advantages associated with the exemplary embodiment will be apparent.

Shown are.

DESCRIPTION OF PREFERRED EMBODIMENTS

Figure 2:
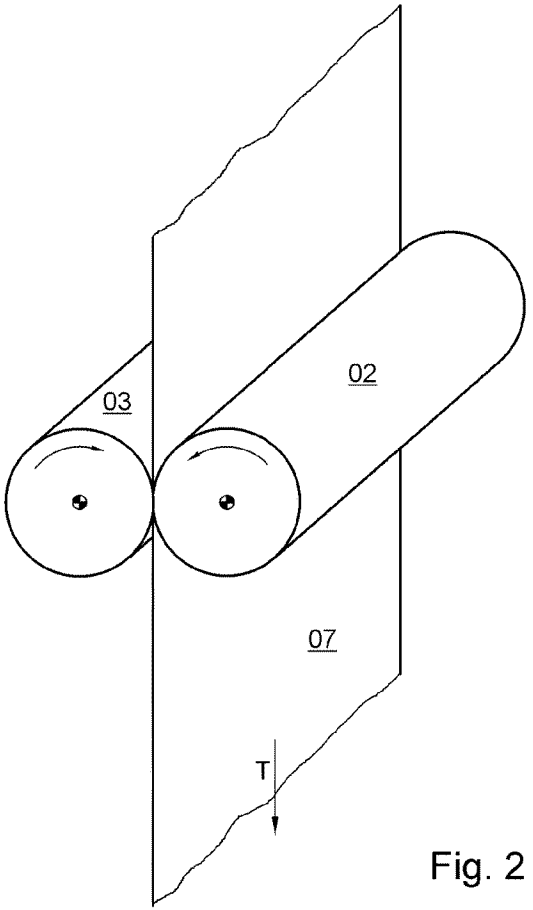
FIG. 2 the printing unit of FIG. 1 with a printing substrate.
Figure 1:
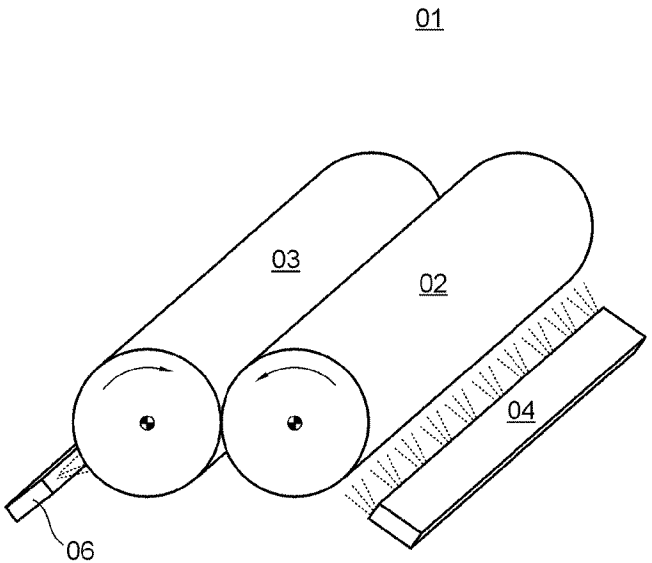
FIG. 1 a printing unit of a rotary printing machine without printing substrate.

FIG. 1 and FIG. 2 each show, by way of example, schematic and greatly simplified illustrations of a printing unit 01 of a rotary printing machine used, e.g. in security printing or package printing, e.g. a rotary printing machine for printing in an offset printing process, with printing unit 01 having two printing unit cylinders 02; 03 that cooperate, i.e. are thrown onto one another, during the printing process. Printing unit 01, which preferably is or at least can be operated remotely from a control console (not shown) associated with the rotary printing machine, at least has at least one inking unit (not shown in FIGS. 1 and 2) and optionally at least one dampening unit (not shown in FIGS. 1 and 2) for each of the two cooperating printing unit cylinders 02; 03. If the rotary printing machine is configured as an offset rotary printing machine, at least one forme cylinder (not shown in FIGS. 1 and 2) is assigned to each of the two cooperating printing unit cylinders 02; 03, which are in turn each embodied as a transfer cylinder or as a blanket cylinder. For each of the two cooperating printing unit cylinders 02; 03, a washing device 04; 06 is preferably also provided, which can be used to clean printing ink off of each of the printing unit cylinders 02; 03. Each of the printing unit cylinders 02; 03 can transfer at least one print image onto a printing substrate 07 (FIG. 2), and a plurality of print images can preferably be arranged one behind the other in the circumferential direction of each printing unit cylinder 02; 03. A plurality of print images can also be arranged side by side in the axial direction of each printing unit cylinder 02; 03. Each of the print images may be monochromatic or multi-colored. The direction of rotation of each printing unit cylinder 02; 03 is indicated in each of the figures by a directional arrow. The transport direction T provided for the transport of printing substrate 07 through printing unit 01 is likewise indicated by a directional arrow (FIG. 2). In the printing unit 01 shown in FIG. 2, e.g. in production printing on the rotary printing machine, the first side of printing substrate 07, e.g. the front side thereof, is printed by means of the first printing unit cylinder 02 and the second side of printing substrate 07, opposite the first side, e.g. the reverse side thereof, is printed in the printing process by means of the second printing unit cylinder 03 cooperating with the first printing unit cylinder 02. Printing unit 01 of the rotary printing machine is thus suitable for printing on opposite sides of printing substrate 07 simultaneously in recto and verso printing without turning said printing substrate 07, i.e. in a simultaneous printing process. To check the register accuracy of print images to be printed onto the two opposite sides of printing substrate 07 in production printing on the rotary printing machine, and thus to verify the correct setting of the rotary printing machine for the printing process, a method having the following method steps is proposed:

Preferably during the makeready phase of the rotary printing machine, a print image is first printed by the first printing unit cylinder 02 onto the second printing unit cylinder 03, in that the first printing unit cylinder 02, inked with at least one printing ink, is placed in direct contact with the second printing unit cylinder 03, so that when the printing cylinders 02; 03 are thrown onto one another and rotated, e.g. said rotation being initiated from the control console, a print image to be printed by the first printing unit cylinder 02 is transferred directly and immediately to the lateral surface of the second printing unit cylinder 03. Printing substrate 07, e.g. a single sheet or a sequence of multiple sheets or a printing substrate web, is then guided through the roller nip of the two printing unit cylinders 02; 03 that are thrown onto one another, so that printing substrate 07 is placed in contact with the two cooperating printing unit cylinders 02; 03 and is thereby printed such that the print image that has been printed onto the second printing unit cylinder 03 is printed, together with the same or a different print image that will be printed by the second printing unit cylinder 03 during the production printing phase of the rotary printing machine, onto the same side of printing substrate 07. These two print images printed together on the same side of printing substrate 07 are then checked and/or measured to determine their register accuracy.

The check for register accuracy of the print images printed on the same side of printing substrate 07, which is performed e.g. outside of the rotary printing machine, in particular at an inspection table, is carried out, e.g. in that the positions relative to one another of the print images to be printed on the two opposite sides of printing substrate 07 during the production printing phase on the rotary printing machine are checked, e.g. automatically or by a technician, e.g. with the aid of an optical system, to determine whether they are in a prescribed relationship to one another, preferably factoring in specified tolerances. The specified tolerances are typically within a range of significantly less than 1 millimeter. The relationship involving the relative position of the print images to be printed onto both sides of printing substrate 07 during the production printing phase on the rotary printing machine, but printed together on the same side of printing substrate 07 for the purpose of checking their register accuracy, consists, e.g. in that these print images are arranged as congruently as possible, or complementing one another to form a single geometric figure, or e.g. separated from one another in their respective positions at a fixed distance from one another, e.g. defined by the setpoint value. A deviation from the setpoint value specified for this relationship, in particular beyond the prescribed tolerances, will have a negative impact on quality. A detected deviation can also be measured, e.g. by means of the optical system, and the measured value used to calculate at least one correcting variable for adjusting the rotary printing machine. The optical system includes at least one detection device, e.g. in the form of a camera, and typically an illumination device, and in particular a digital image processing device for analyzing the photographic image of the print image or print images in question, captured by the at least one detection device.

If the checked register accuracy of the print images to be printed on opposite sides of printing substrate 07 during the production printing phase of the rotary printing machine, but printed together on the same side of printing substrate 07 for the purpose of checking their register accuracy, is found to be satisfactory, a cylinder washing of at least the second printing unit cylinder 03, onto which a print image was transferred by the first printing unit cylinder 02 in particular prior to the start of the production printing phase of the rotary printing machine, is preferably carried out to remove the print image that was transferred onto the second printing unit cylinder, in that the washing device 06 associated with this second printing unit cylinder 03 is activated automatically or manually, e.g. from the control console. Optionally, both printing cylinders 02; 03 are washed by activating their respective washing devices 04; 06.

If the checked register accuracy of the print images to be printed onto opposite sides of printing substrate 07 during the production printing phase of the rotary printing machine, but printed together on the same side of printing substrate 07 for the purpose of checking their register accuracy, is found to be unsatisfactory, i.e. not compliant with the quality level required, a modified, i.e. improved adjustment of the rotary printing machine is carried out, after which each of the above-described process steps is preferably repeated until the register accuracy is found to be satisfactory. The improved adjustment of the rotary printing machine is carried out, e.g. based upon the calculation of the at least one correcting variable for the purpose of adjusting the rotary printing machine, with said correcting variable having resulted from the measured value of the detected deviation from the relevant setpoint value of the prescribed relationship for the relative positions of the print images to be printed onto opposite sides of printing substrate 07 during the production printing phase of the rotary printing machine, but printed together on the same side of printing substrate 07 for the purpose of checking their register accuracy. It is preferably provided that at least the second printing unit cylinder 03, onto which a print image has been transferred by the first printing unit cylinder 02, is washed after each check for register accuracy.

Figure 3:
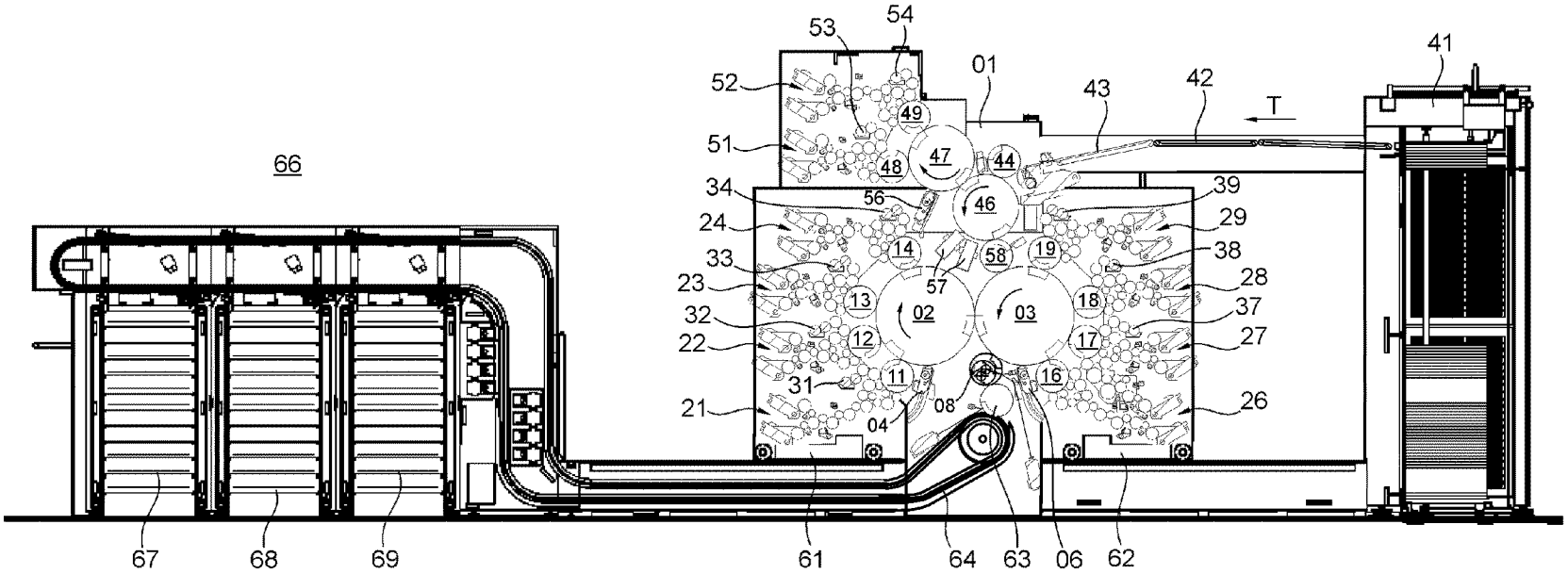
FIG. 3 a rotary printing machine using the invention.

Printing unit 01, shown highly simplified in FIGS. 1 and 2, is a component, e.g. of the rotary printing machine described in the following in reference to FIG. 3 by way of example, and preferably used in security printing. Printing unit 01 comprises the first printing unit cylinder 02 and the second printing unit cylinder 03, in a cooperative arrangement, the first printing unit cylinder 02 being used, e.g. for recto printing and the second printing unit cylinder 03 being used, e.g. for verso printing. In this arrangement of printing unit cylinders 02; 03, a printing substrate 07, configured, in particular, as a sheet, guided through the roller nip between the first printing unit cylinder 02 and the second printing unit cylinder 03 can be printed on both sides simultaneously, i.e. at the same time. The rotary printing machine shown by way of example in FIG. 3 is configured, e.g. as a multi-color offset rotary printing machine. Each of the two printing unit cylinders 02; 03 is therefore configured as a transfer cylinder, in particular as a blanket cylinder. In this printing unit 01 illustrated by way of example, e.g. four forme cylinders 11 to 14 are or at least can be thrown onto the first printing unit cylinder 02 used, e.g. for recto printing, and e.g. four forme cylinders 16 to 19 are or at least can be thrown onto the second printing unit cylinder 03 used, e.g. for verso printing. Each of forme cylinders 11 to 14; 16 to 19 is also referred to as a plate cylinder. At least one inking unit 21 to 24; 26 to 29 is or at least can be thrown onto each of forme cylinders 11 to 14; 16 to 19. In addition, in conjunction with each inking unit 21 to 24; 26 to 29, a dampening unit 31 to 34; 37 to 39 may also be provided, which is required for a wet offset printing process. The recto-side inking units 21 to 24 and where applicable also the recto-side dampening units 31 to 34 are arranged, e.g. in a movable frame carriage 61. The verso-side inking units 26 to 29 and, where applicable, also the verso-side dampening units 37 to 39 can likewise be arranged, e.g. in a movable frame carriage 62; these two frame carriages 61; 62 can be moved away from one another in opposite directions and can be moved toward one another in mutually facing directions, and each of said frame carriages 61; 62 can be moved up to or away from the stationary printing unit 01. A plurality of printing blankets, e.g. three, are arranged one behind the other on the circumferential surface of each of the two printing unit cylinders 02; 03. Each of forme cylinders 11 to 14; 16 to 19 has e.g. only a single printing forme on its circumferential surface, with one printing forme length oriented in the circumferential direction preferably corresponding in each case to one printing blanket length oriented in the circumferential direction. Washing device 04, in particular configured as a blanket washing device, is or at least can be thrown onto the first printing unit cylinder 02. Washing device 06, in particular configured as a blanket washing device, is or at least can be thrown onto the second printing unit cylinder 03. Also preferably provided is an inspection unit 08, said inspection unit 08 being configured, in particular, as an optical system having a detection device in the form of a camera and an illumination device. Inspection unit 08 is also used, e.g. for checking the register accuracy of print images.

A sheet supplied by a sheet feeder 41 is fed by means of a first conveyor device 42, embodied e.g. as a conveyor belt, in the transport direction T to a sheet feeder 43, and sheet feeder 43 feeds the sheet in question into printing unit 01. Printing unit 01 receives the sheet in question from sheet feeder 43, e.g. from a first transfer drum 44. In an advantageous configuration of the rotary printing machine shown by way of example in FIG. 3, it is provided that the recto side of the printing sheet in question is first printed with at least one printing ink, preferably with a plurality of printing inks, e.g. two, each of which is dried, e.g. by irradiation with ultraviolet (UV) light. For this purpose, a printing (impression) cylinder 46 that cooperates with the first transfer drum 44 is provided, onto which a transfer cylinder 47 embodied as a blanket cylinder is or at least can be thrown. One or more forme cylinders 48; 49, each configured as a plate cylinder, for example, is or at least can be thrown onto said transfer cylinder 47. Each of these forme cylinders 48; 49 is inked up by an additional inking unit 51; 52, and each of these inking units 51; 52 can in turn cooperate, if necessary, with a dampening unit 53; 54. Of course, a washing device 56 configured in particular as a blanket washing device may also be provided for the optionally provided transfer cylinder 47. A sheet printed in the roller nip between impression cylinder 46 and transfer cylinder 47, e.g. on the recto side, with at least one UV-drying printing ink is preferably guided past at least one UV dryer 57, after which said sheet is transferred by means of a second transfer drum 58 to the second printing cylinder 03 and is guided into the roller nip between the first printing unit cylinder 02 and the second printing unit cylinder 03. After a sheet has passed through the roller nip between the first printing unit cylinder 02 and the second printing unit cylinder 03, it can be inspected inline, i.e. within the rotary printing machine, by means of inspection unit 08 and checked, e.g. for the register accuracy of its printed images, before being transferred by means of a third transfer drum 63 to a second conveyor device 64, embodied, e.g. as a chain conveyor. The second conveyor device 64 conveys the sheet from printing unit 01 to a delivery 66, the delivery 66 having, in particular, a plurality of delivery pile compartments 67; 68; 69, e.g. three.

It is preferably provided to carry out the proposed method in a rotary printing machine, illustrated by way of example in FIG. 3. This is because the proposed method enables a simple check for register accuracy of print images printed simultaneously onto both sides of a printing substrate 07.

While preferred embodiments of a method for checking the maintenance of register of printed images to be printed on two opposite sides of a printing material, in accordance with the present invention, have been set forth fully and completely hereinabove, it will be apparent to one of skill in the art that various changes could be made thereto, without departing from the true spirit and scope of the present invention, which is accordingly to be limited only by the appended claims.

The invention claimed is:

1. A method for checking the register accuracy of print images to be printed onto two opposite sides of a printing substrate (07), in which the first side of the printing substrate (07) is printed in a rotary printing machine by means of a first printing unit cylinder (02), and in which the second side of the printing substrate (07), opposite the first side, is printed in the printing process by means of a second printing unit cylinder (03) cooperating with the first printing unit cylinder (02), characterized in that a print image is printed by the first printing unit cylinder (02) onto the second printing unit cylinder (03), wherein the printing substrate (07) is then printed in contact with the two cooperating printing unit cylinders (02; 03), in that the print image printed onto the second printing unit cylinder (03) is printed, together with the same or a different print image, to be printed by the second printing unit cylinder (03) in the production printing phase of the rotary printing machine, onto the same side of the printing substrate (07), wherein these print images printed together on the same side of the printing substrate (07) are then checked with regard to their register accuracy.

2. The method according to claim 1 characterized in that it is carried out during the makeready phase of the rotary printing machine and/or in that it is used in security printing or in package printing.

3. The method according to claim 1, characterized in that a single sheet or a sequence of sheets or a printing substrate web is used as the printing substrate (07).

4. The method according to claim 1, characterized in that a rotary printing machine that prints by an offset printing process is used.

5. The method according to claim 1, characterized in that the check for register accuracy of the print images to be printed onto opposite sides of the printing substrate (07) during the production printing phase of the rotary printing machine, but printed together on the same side of the printing substrate (07) for the purpose of checking their register accuracy, is carried out in that the relative positions of the print images printed on the same side of the printing substrate (07) are checked to determine whether they are in a prescribed relationship to one another.

6. The method according to claim 5, characterized in that the relationship involving the relative position of the print images to be printed onto both sides of the printing substrate (07) consists in these print images being arranged congruently, or complementing one another to form a single geometric figure, or separated from one another in their respective positions at a fixed distance from one another.

7. The method according to claim 5, characterized in that in the case of a deviation of the predefined relationship from a setpoint value, the detected deviation is measured, and the measured value is used to calculate at least one correcting variable for adjusting the rotary printing machine.

8. The method according to claim 5, characterized in that the check for register accuracy is performed outside of the rotary printing machine on an inspection table.

9. The method according to claim 1, characterized in that at least the second printing unit cylinder (03), onto which a print image has been transferred from the first printing unit cylinder (02), is washed prior to the production printing phase of the rotary printing machine and/or after each check for register accuracy.

10. The method according to claim 1, characterized in that the check for register accuracy, performed within the rotary printing machine or outside of the rotary printing machine on an inspection table, is carried out in either case by means of an optical system, wherein the optical system in either case has at least one detection device and one image processing device for analyzing the respective image of the relevant print image or the relevant print images captured by the detection device.

* * * * *